US008213845B2

(12) United States Patent
Herko et al.

(10) Patent No.: US 8,213,845 B2
(45) Date of Patent: Jul. 3, 2012

(54) CORONA TREATMENT FOR INTERMEDIATE TRANSFER MEMBER OVERCOAT ADHESION

(75) Inventors: Jonathan H. Herko, Walworth, NY (US); Jin Wu, Pittsford, NY (US); Scott J. Griffin, Fairport, NY (US); Michael S. Roetker, Webster, NY (US); Dante M. Pietrantoni, Rochester, NY (US); David W. Martin, Walworth, NY (US); Francisco J. Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 406 days.

(21) Appl. No.: 12/573,297

(22) Filed: Oct. 5, 2009

(65) Prior Publication Data

US 2011/0081610 A1 Apr. 7, 2011

(51) Int. Cl.
*G03G 15/01* (2006.01)

(52) U.S. Cl. ..... 399/302; 430/132

(58) Field of Classification Search ..... 399/302; 430/132, 532, 937
See application file for complete search history.

(56) References Cited

U.S. PATENT DOCUMENTS

| | | | | |
|---|---|---|---|---|
| 4,666,735 | A | 5/1987 | Hoover et al. | |
| 5,582,949 | A * | 12/1996 | Bigelow et al. | 430/132 |
| 5,873,018 | A * | 2/1999 | Aoto et al. | 399/302 |
| 6,044,243 | A * | 3/2000 | Hara | 399/302 |
| 6,180,309 | B1 * | 1/2001 | Maty et al. | 430/130 |
| 6,528,226 | B1 | 3/2003 | Yu et al. | |

* cited by examiner

*Primary Examiner* — David Gray
*Assistant Examiner* — G. M. Hyder
(74) *Attorney, Agent, or Firm* — Oliff & Berridge, PLC

(57) ABSTRACT

An intermediate transfer member substrate with an overcoat and a process for preparing the intermediate transfer member substrate with an overcoat layer by application of corona treatment to the surface of the intermediate transfer member substrate to enhance the interfacial adhesion between the overcoat and intermediate transfer member substrate.

20 Claims, 3 Drawing Sheets

CORONA TREATMENT FOR INTERMEDIATE TRANSFER MEMBER OVERCOAT ADHESION

TECHNICAL FIELD

The present disclosure is generally directed to an intermediate transfer member substrate with an imageable seam overcoat, and in particular, to a process for subjecting an intermediate transfer member to corona treatment prior to application of an imageable seam overcoat that significantly improves the adhesion characteristics of the imageable seam overcoat.

BACKGROUND

In electrostatographic printing and photocopy machines in which the toner image is transferred from the transfer member to the image receiving substrate, it is desired that the transfer of the toner particles from the transfer member to the image receiving substrate be substantially 100 percent. Less than complete transfer to the image receiving substrate results in image degradation and low resolution. Complete transfer is particularly desirable when the imaging process involves generating full color images since undesirable color deterioration in the final colors may occur when the color images are not completely transferred from the transfer member.

However, in the electrostatic transfer applications, the use of seamed intermediate transfer belts results in insufficient transfer in that the developed image occurring on the seam is not adequately transferred. This incomplete transfer is partially the result of the difference in seam height to the rest of the intermediate transfer belt. A "bump" is formed at the seam, thereby hindering transfer and mechanical performance. A bump in the intermediate transfer belt may also introduce poor motion quality into the system as it passes various elements such as cleaning blades, roller nips, and others.

U.S. application Ser. No. 12/550,486, which issued as U.S. Pat. No. 8,084,112 to Wu et al. proposes applying an overcoat to an intermediate transfer belt substrate, which functionally masks the appearance of the imageable seam. Although print test results demonstrate the ability of the overcoat to mask the imageable seam and improve imageability of the seam, inferior adhesion of the overcoat to the intermediate transfer member substrate has been observed, resulting in a significant obstacle to application of overcoat technology to an intermediate transfer member substrate. The present disclosure addresses the problem of inferior adhesion of an overcoat to the intermediate transfer member substrate, after applying an imageable seam overcoat to an intermediate transfer member substrate.

In order to significantly improve adhesion of an imageable seam overcoat to the intermediate transfer member substrate, the present disclosure provides a process for applying a corona pretreatment process to an intermediate transfer member substrate to modify the surface characteristics of the intermediate transfer member substrate prior to applying the imageable seam overcoat, thereby improving the overcoat adhesion at the interface of the overcoat and the intermediate transfer member substrate. This corona treatment process effectively eliminates the need for a separate adhesive or primer layer to aid adhesion of the imageable seam overcoat and the intermediate transfer member substrate.

The corona treatment process may be applied while the intermediate transfer member substrate material is in roll form or belt form. If the intermediate transfer member substrate material is in roll form, then the corona treatment apparatus may include a fixture having an unwind or rewind functionality, a web guide system, and a corona generation apparatus. The corona generation apparatus may include a high voltage power supply, an electrode, and a ground roll or plate. Similarly, if the intermediate transfer member substrate material is in belt form, then the corona treatment apparatus may include an actively steered belt cycling fixture, which contains the aforementioned corona generation apparatus.

Various corona discharge methods are known. U.S. Pat. No. 6,528,226 describes the application of plasma treatment to a photoreceptor. The appropriate components and process aspects of the foregoing patent publication may be selected for the present disclosure in embodiments thereof, and the entire disclosure of the above-mentioned reference is totally incorporated herein by reference.

SUMMARY

The present disclosure addresses the problem of inferior adhesion of an overcoat to the intermediate transfer member substrate. According to one aspect of the present disclosure, a process is provided for preparing an intermediate transfer member substrate with an overcoat layer without an adhesive or primer layer. The process includes applying a corona treatment to the intermediate transfer member substrate; and applying the overcoat layer to the corona treated intermediate transfer member substrate.

According to another aspect of the present disclosure, an intermediate transfer member is provided, including an intermediate transfer member substrate, and an overcoat layer adhered to the intermediate transfer member substrate, wherein the overcoat layer is adhered to the substrate in the absence of any adhesive.

EMBODIMENTS

The present disclosure is directed to an overcoated intermediate transfer member and a method for enhancing interfacial adhesion between an imageable seam overcoat and an intermediate transfer member substrate by treating the surface of an intermediate transfer member substrate with a corona effluent prior to applying the imageable seam overcoat.

In embodiments of the present disclosure, the corona treatment only affects the surface of the intermediate transfer member substrate. That is, the treatment physically and/or chemically alters only the surface of the intermediate transfer member substrate. Specifically, such treatment enhances chemical bonding between the surface of the intermediate transfer member substrate and the applied imageable seam overcoat so that the adhesion between the surface of the intermediate transfer member substrate and the imageable seam overcoat are further enhanced.

According to the present disclosure, the specific parameters of the treatment step will generally depend upon, for example, the specific materials of the intermediate transfer member substrate to be treated, the amount of preparation desired, and/or the specific overcoating layer material to be applied.

A suitable method of treatment involves the application of a corona discharge to a substrate. Corona discharge treatment is illustrated, for example, in U.S. Pat. No. 4,666,735, the entire disclosure of which is incorporated herein by reference. The corona discharge treatment is performed upon the surface of intermediate transfer member substrate before an imageable seam overcoat is applied. In an embodiment, the surface treatment may be performed with a time interval between the surface treatment and the application of the imageable seam overcoat.

Values of the various parameters of the corona treatment will vary depending, for example, on the surface of the intermediate transfer member substrate material being treated. Thus, for example, the power setting, wattage, and the like, of the equipment may be adjusted to modify the properties of the surface of the intermediate transfer member substrate, including but not limited to, surface energy and surface wetting properties. Furthermore, corona treatment time may significantly effect the surface properties of the substrate. Adequate and acceptable processing parameters will be apparent to those skilled in the art based on the present disclosure, and/or may be readily determined through routine testing.

Figure 1:
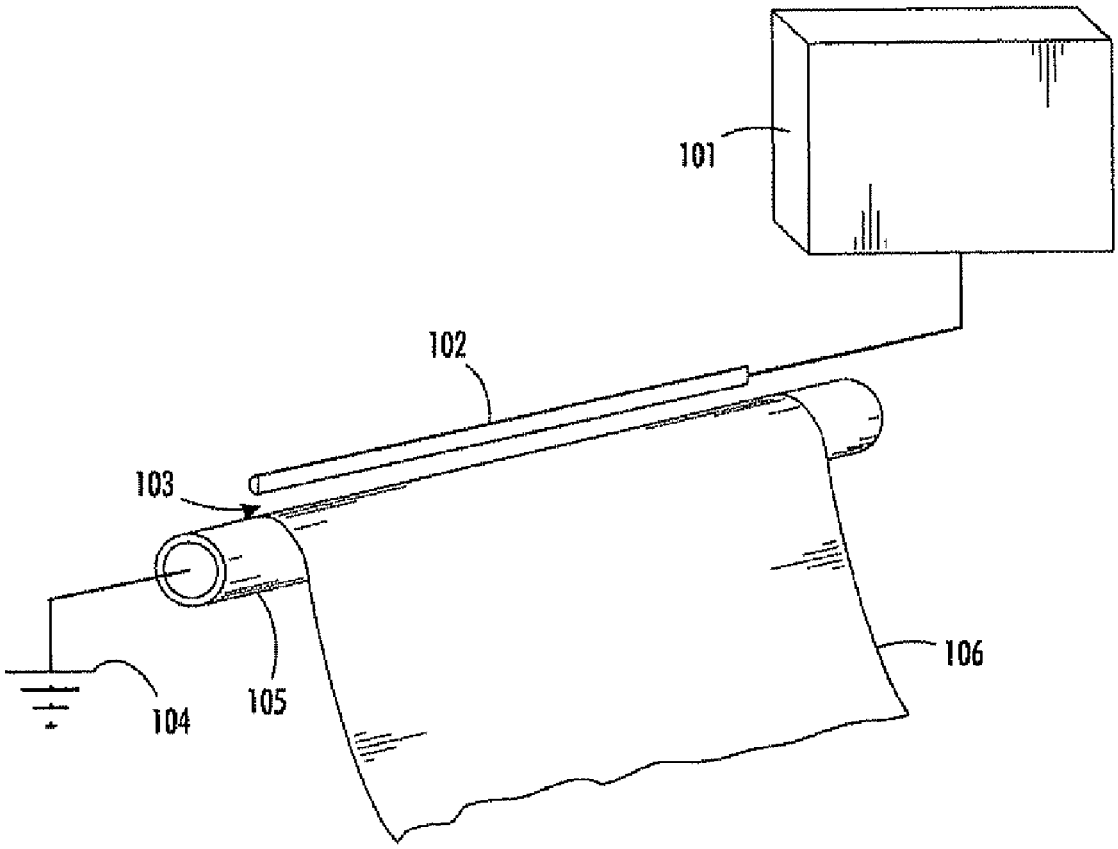
FIG. 1 shows an exemplary corona treatment apparatus for an intermediate transfer member substrate material in roll form.

FIG. 1 is an exemplary corona treatment apparatus for an intermediate transfer member substrate material in roll form, containing a high voltage supply 101; electrode 102, air gap 103, ground 104, grounded backer roll 105, and substrate 106.

High voltage power supply 101 is connected to electrode 102. "High voltage power supply" refers, for example, to a voltage ranging from about 0.25 kilovolts to about 10 kilovolts. The high voltage power supply may use DC power. A suitable high voltage power supply may, for example, include a TREK® COR-A-TROL 610 Power Supply (manufactured by TREK®).

The corona treatment apparatus may operate at a power level and exposure duration sufficient to achieve the objectives of the present disclosure. For example, a corona treatment apparatus may operate at a fixed voltage ranging from about 3,000 V to about 10,000 V. The corona treatment apparatus may operate at a varied current ranging from about 200 microamps to about 1000 microamps, or about 300 microamps to about 700 microamps, or about 450 microamps to about 550 microamps. The exposure time of the corona treatment may occur for about 2 hours or less, such as about 0.5 minutes to about 15 minutes, or about 2 minutes to about 5 minutes.

Electrode 102 may include various configurations that allow for the intermediate transfer member substrate in roll or belt form to pass through the corona field generated by the electrode 102. The configuration may include the rod-shaped electrode in FIG. 1. The electrode 102 may be broader to encompass a wider surface area of the substrate passing through the corona field generated at electrode 102. Electrode 102 may also be in various other shapes, including flat or tubular electrodes. Furthermore, pin arrays tend to produce more even treatment over a longer life span and are less susceptible to contamination than wire electrodes.

Furthermore, electrode 102 may include various conductive materials, including electrically conductive metals. Typical electrically conductive metals may include aluminum, zirconium, niobium, tantalum, vanadium and hafnium, titanium, nickel, stainless steel, chromium, tungsten, molybdenum, mixtures thereof, and the like. If desired, an alloy of suitable metals may be used. Typical metal alloys may contain two or more metals such as zirconium, niobium, tantalum, vanadium and hafnium, titanium, nickel, stainless steel, chromium, tungsten, molybdenum, and the like, and mixtures thereof.

In the exemplary embodiment shown in FIG. 1, the width of air gap 103 must be sufficient to allow for a corona discharge. For example, the width of the air gap may range from about 1 millimeters to about 20 millimeters, or about 5 millimeters to about 15 millimeters. The air gap may be configured in an environment that includes gases suitable to achieve the desired corona discharge effect, including, but not limited to, oxygen.

The grounded back roll 105 (connected to ground 104) unwinds or rewinds the substrate 106 allowing substrate 106 to pass through the corona field. Grounded back roll 105 may include various types of nonconductive materials, which do not interfere with the corona treatment process. Suitable materials for the ground back roll include electrically conductive metals. Typical electrically conductive metals may include aluminum, zirconium, niobium, tantalum, vanadium and hafnium, titanium, nickel, stainless steel, chromium, tungsten, molybdenum, mixtures thereof, and the like. If desired, an alloy of suitable metals may be used. Typical metal alloys may contain two or more metals such as zirconium, niobium, tantalum, vanadium and hafnium, titanium, nickel, stainless steel, chromium, tungsten, molybdenum, and the like, and mixtures thereof.

Substrate 106 may include various types of intermediate transfer member substrates. In embodiments, intermediate transfer member substrates include homogenous substrates that are robust enough to undergo multiple cycling through rigorous use. The term "homogeneous" refers, for example, to the entire layer having the same average composition as opposed to a substrate that has distinct layers such as a supporting substrate and a separate conducting layer. Examples of suitable substrate materials include polyimides with or without conductive fillers, such as semiconductive polyimides such as polyamideimides, polyanaline polyimide, carbon-filled polyimides, carbon-filled polycarbonate, and the like. Examples of commercially available polyimide substrates include KAPTON® and UPLIEX® both from DuPont, and ULTEM from GE.

The substrate may also include a filler. In an embodiment, the filler may be present in an amount, for example, of from about 1 to about 60, such as from about 2 to about 50, or from about 3 to about 40 percent by weight of total solids. Examples of suitable fillers for use in the substrate include carbon fillers, metal oxide fillers, doped metal oxide fillers, other metal fillers, other conductive fillers, and the like. Specific examples of fillers include carbon fillers such as carbon black, fluorinated carbon black, graphite, low conductive carbon, and the like, and mixtures thereof; metal oxides such as indium tin oxide, zinc oxide, iron oxide, aluminum oxide, copper oxide, lead oxide, and the like, and mixtures thereof; doped metal oxides such as antimony-doped tin oxide, antimony-doped titanium dioxide, aluminum-doped zinc oxide, similar doped metal oxides, and mixtures thereof; particles such as silicone particles and the like; and polymer particles such as polytetrafluoroethylene, polypyrrole, polyaniline, doped polyaniline and the like, and mixtures thereof.

The thickness of the intermediate transfer substrate may range from about 60 micrometers to about 500 micrometers, such as from about 60 micrometers to 120 micrometers, or from about 76 micrometers to 84 micrometers. The seam of the intermediate transfer member may be a weldable seam.

After the corona treatment is applied to the intermediate transfer member substrate, the imageable seam overcoat may be applied to the surface of the intermediate transfer member substrate immediately, or within between about 10 seconds and about 30 minutes after the surface treatment to give desirable results. In other embodiments, the imageable seam overcoat may be applied to the surface of the intermediate transfer member substrate within about 1 or 2 hours, or 4 or 8 hours, or even 12 or 24 hours or more of the surface treatment to impart a satisfactory outcome.

The imageable seam overcoat materials may include semi-conductive overcoat materials having seam-making properties or capabilities, including (but not limited to) semi-conductive polymeric materials (such as an acrylic polyol). Another embodiment of the overcoat material may include combinations of the components listed below. For example, the overcoat material may include a mixture of tetrakis(butoxymethyl)glycoluril (commercially available under the commercial name of CYMEL® 1170, manufactured by Cytec Industries), an acrylic resin (commercially available under the commercial name of DORESCO® TA22-8, manufactured by Lubrizol Corp.), p-toluenesulfonic acid (pTSA), and silicone modified polyacrylate (commercially available under the commercial name of SILCLEAN® 3700, manufactured by BYK-Chemie) in 1-Methoxy-2-propanol (commercially available under the commercial name of DOWANOL®, manufactured by Dow Chemical Co.); a mixture of DORESCO® TA22-8, SILCLEAN® 3700, and pTSA in 1-Methoxy-2-propanol; or a mixture of DORESCO® TA22-8, SILCLEAN® 3700, pTSA, and carbon black (commercially available under the commercial name of Color Black FW-1®, manufactured by Evonik Industries) in 1-Methoxy-2-propanol.

The thickness of the continuous overcoat layer selected may depend upon the seam masking properties of the overcoat material. The thickness of the overcoat layer may range from about 5 micrometers to about 25 micrometers, or about 8 micrometers to about 20 micrometers, or about 10 micrometers to about 15 micrometers.

Any suitable and conventional technique may be used to mix and thereafter apply the imageable seam overcoat. Typical application techniques include flow coating, spraying, dip coating, roll coating, wire wound rod coating, and the like. Drying of the deposited coating may be effected by any suitable conventional technique such as oven drying, infra red radiation drying, air drying, UV curing, and the like.

The intermediate transfer member substrate formed according to the present disclosure may be incorporated into an electrophotographic imaging apparatus, including an electrostatographic imaging member, a developer; an intermediate transfer member (including the intermediate transfer member substrate described herein), and a fuser member. The electrostatographic imaging member may be a photosensitive member, such as a photoreceptor, used in electrophotographic (xerographic) imaging processes. The electrostatographic imaging member can be in a rigid drum configuration or in a flexible belt configuration.

The corona field generated within air gap 103 between the electrode and the ground modifies the properties of the surface of the intermediate transfer member substrate, which is treated by passing the substrate through the corona field. Specifically, the surface energy is increased and surface wetting properties of the intermediate transfer member substrate are improved after application of the corona treatment to the intermediate transfer member substrate.

The corona treatment apparatus may also include a control system that controls operation of the corona treatment apparatus and the key parameters of the corona treatment apparatus, including treatment time (duration of corona treatment), voltage, current, and ozone evacuation. The control system will also control belt tracking for the corona treatment apparatus, which steers the belt back and forth as the belt is rotating. This control system may be implemented on a computer directly connected to the corona treatment apparatus or at a remote computer terminal, which is connected to the corona treatment apparatus by a network connection. An exemplary embodiment of this control system may be a program stored on a computer readable storage medium. In an embodiment, the control system provides a graphic user interface to facilitate user input of control parameters.

Figure 2:
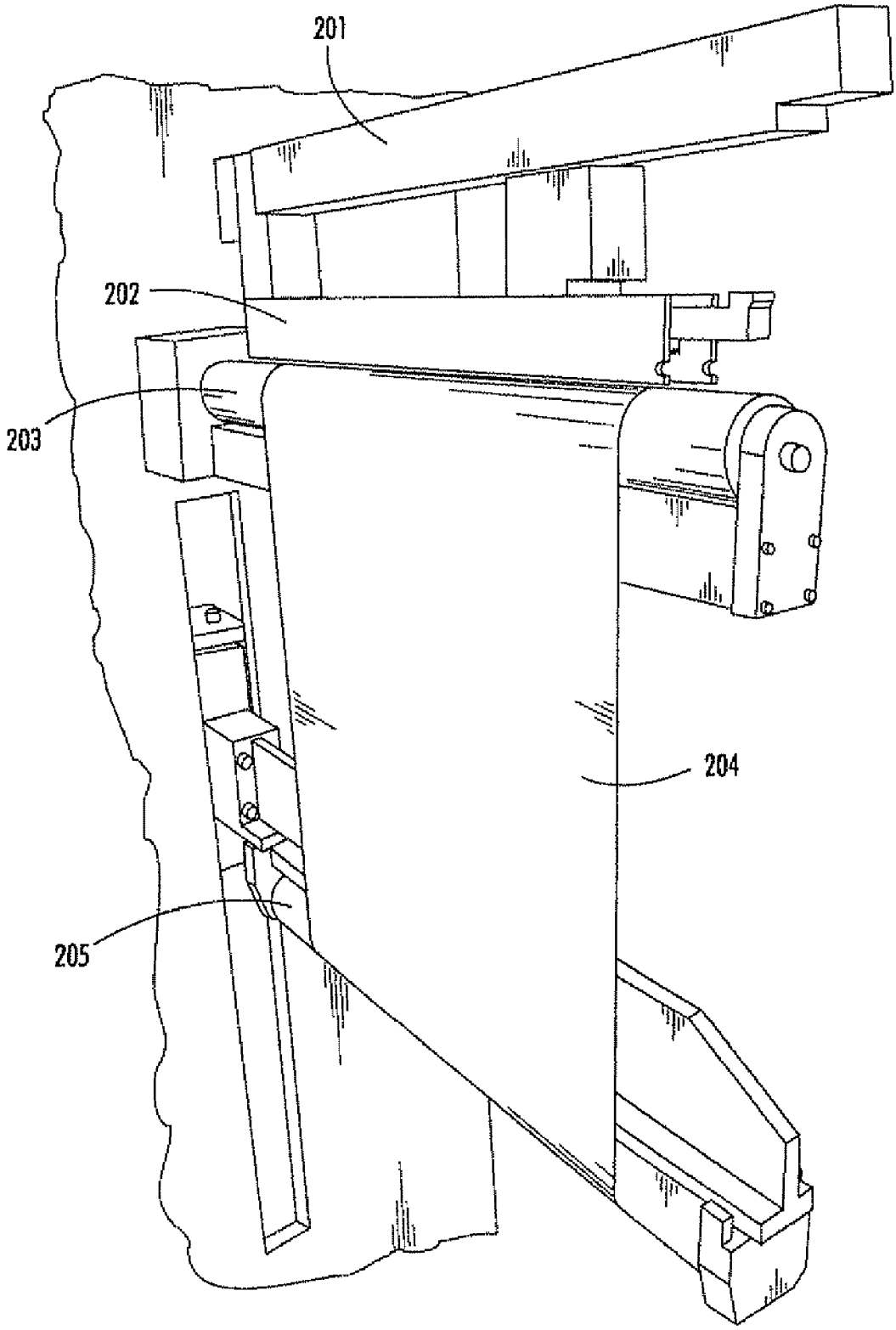
FIG. 2 shows an exemplary corona treatment apparatus for an intermediate transfer member substrate material in belt form.

FIG. 2 shows an exemplary corona treatment apparatus for an intermediate transfer member substrate material in belt form. The apparatus in FIG. 2 includes charge device mount 201, charge device 202, grounded drive roller 203, intermediate transfer belt 204, tensioning roller 205, and a high voltage power supply (not shown).

Charge device mount 201 is a support system onto which charge device 202 is mounted. Charge device mount 201 may include various configurations that allow charge device 202 to be properly secured and positioned relative to grounded drive roller 203 and intermediate transfer belt 204.

Charge device 202 may include various corona devices may be used according to the present disclosure. For example, one suitable corona device is an Enercon Model A1 corona surface treatment device available from Enercon Industries Corporation.

The grounded drive roller 203 may include various types of nonconductive materials, which do not interfere with the application of the corona treatment to the intermediate transfer member substrate. Suitable materials for the ground back roll include electrically conductive metals. Typical electrically conductive metals may include aluminum, zirconium, niobium, tantalum, vanadium and hafnium, titanium, nickel, stainless steel, chromium, tungsten, molybdenum, mixtures thereof, and the like. An alloy of suitable metals may also be used. Typical metal alloys may contain two or more metals such as zirconium, niobium, tantalum, vanadium and hafnium, titanium, nickel, stainless steel, chromium, tungsten, molybdenum, and the like, and mixtures thereof.

Tensioning roller 205 is roller unit that is configured to increase the tension of intermediate transfer belt 204, which is in belt form in the embodiment shown in FIG. 2. Tensioning roller 205 may be pneumatically actuated.

In the exemplary embodiment shown in FIG. 2, the belt is tensioned between grounded drive roller 203 and tensioning roller 205. The corona charge device is mounted above grounded drive roller 203. Grounded drive roller 203 drives the belt in a cyclical fashion through the corona discharge produced between the corona charge device and grounded drive roller 203.

As an exemplary mode of operation of the embodiment shown in FIG. 2, the corona treatment apparatus in FIG. 2 is operated by opening the door of the belt fixture, raising tensioning roller 205, and sliding intermediate transfer belt 204 onto grounded drive roller 203 and tensioning roller 205. The operator would then increase the tension of tensioning roller 205, which increases the tension of intermediate transfer belt 204; the tension roll is pneumatically (or otherwise) actuated to increase or decrease tension of the belt. The operator then initiates or turns on the rotation function of the belt fixture, and subsequently turns on the corona power supply. At this point, the corona power supply and other parameters (such as current, treatment time, and belt tracking) may also be adjusted to desired values.

Adhesion of the imageable seam overcoat and the intermediate transfer member substrate has been a significant obstacle for applying overcoat technology to intermediate transfer member substrates. However, after corona treatment of the intermediate transfer member substrate, dramatically improved adhesion was observed between the imageable seam overcoat and the intermediate transfer member substrate. After corona treatment of the intermediate transfer member substrate, the imageable seam overcoat could not be separated from the intermediate transfer member substrate using standard mechanical test methods. "Standard mechanical test methods" refers, for example, to a 180 degree peel test, such as described in Yu et al. (U.S. Pat. No. 6,528,226), ASTM D3330, or the like.

Application of corona treatment to the surface of the intermediate transfer member substrate (according to the exemplary mode of operation above) enhances the interfacial adhesion between imageable seam overcoat and intermediate transfer member substrate using corona discharge treatment. More specifically, application of corona treatment to the surface of the intermediate transfer member substrate prior to application of an imageable seam overcoat improves interfacial adhesion between the imageable seam overcoat and intermediate transfer member substrate. After application of corona treatment to the surface of the intermediate transfer member substrate, an increase in surface energy of the treated the intermediate transfer member substrate and improvement of surface wetting properties of the intermediate transfer member substrate is observed.

Before corona treatment of the intermediate transfer member substrate, the surface energy of the intermediate transfer member substrate may range between about 30 dyne/cm to about 40 dyne/cm. After corona treatment of the intermediate transfer member substrate, the surface energy of the intermediate transfer member substrate may be greater than 50 dyne/cm. Alternatively, the surface energy of the intermediate transfer member substrate may range between about 60 dyne/cm to about 80 dyne/cm, or about 65 dyne/cm to about 75 dyne/cm, or about 70 dyne/cm to about 75 dyne/cm. Furthermore, after corona treatment of the intermediate transfer member substrate, water contact angles of less than about 40 degrees are observed, such as water contact angles ranging from about 20 degrees to about 40 degrees, or water contact angles ranging from about 30 degrees to about 40 degrees.

While the present disclosure has been described in conjunction with the specific embodiments described above, it is evident that many alternatives, modifications and variations are apparent to those skilled in the art. Accordingly, embodiments of the present disclosure as set forth above are intended to be illustrative and not limiting. Various changes may be made without departing from the spirit and scope of the present disclosure.

The examples set forth herein below and are illustrative of different compositions and conditions that may be used in practicing the present disclosure. All proportions are by weight unless otherwise indicated. It will be apparent, however, that the present disclosure may be practiced with many types of compositions and may have many different uses in accordance with the present disclosure above and as pointed out hereinafter.

EXAMPLES

Subsequent to corona treatment, evaluation of the surface properties of the substrate shows a dramatic increase in the surface energy and improvement of the surface wetting properties of the substrate, as shown in Table 1. In order to evaluate the surface energy of the intermediate transfer member substrate, a small portion of the treated sample is mounted onto a glass slide. The slide is then placed into a video contact angle measurement device, AST Products VCA 2500XE or the like. The device pipettes precise quantities of one of at least two predetermined liquids, namely deionized water or formamide. The left and right side contact angles of the bead of liquid on the substrate are then recorded. There is a direct mathematical relationship between the differing properties of the various test liquids, the resulting contact angles, and the resulting surface energy. A maximum increase in surface energy and improvement of surface wetting properties was observed at approximately one hour of corona treatment.

TABLE 1

Effect of Corona Treatment on Surface Energy of Intermediate Transfer Member Substrate

| | Sample | | | | | |
|---|---|---|---|---|---|---|
| | Harmonic | | | Geometric | | |
| | Dispersive (dyne/cm) | Polar (dyne/cm) | Total (dyne/cm) | Dispersive (dyne/cm) | Polar (dyne/cm) | Total (dyne/cm) |
| Control (No Corona Treatment) | 21.4 | 18.7 | 40.1 | 23.6 | 13.5 | 37.1 |
| 1 Hour of Corona Treatment | 25.3 | 43.4 | 68.7 | 17.2 | 50.9 | 68.1 |
| 2 Hours of Corona Treatment | 24.4 | 44.0 | 68.4 | 16.0 | 52.4 | 68.4 |

In contrast, an untreated intermediate transfer member substrate with the applied imageable seam overcoat easily delaminates; specifically, the average overcoat adhesion of the untreated intermediate transfer member substrate was 3.91 gF/cm, but may range from 2 to 10 gF/cm. Other methods, such as primers and adhesives, have only resulted in minor improvement in overcoat adhesion, while corona treatment results in a dramatic increase in overcoat adhesion.

Figure 3:
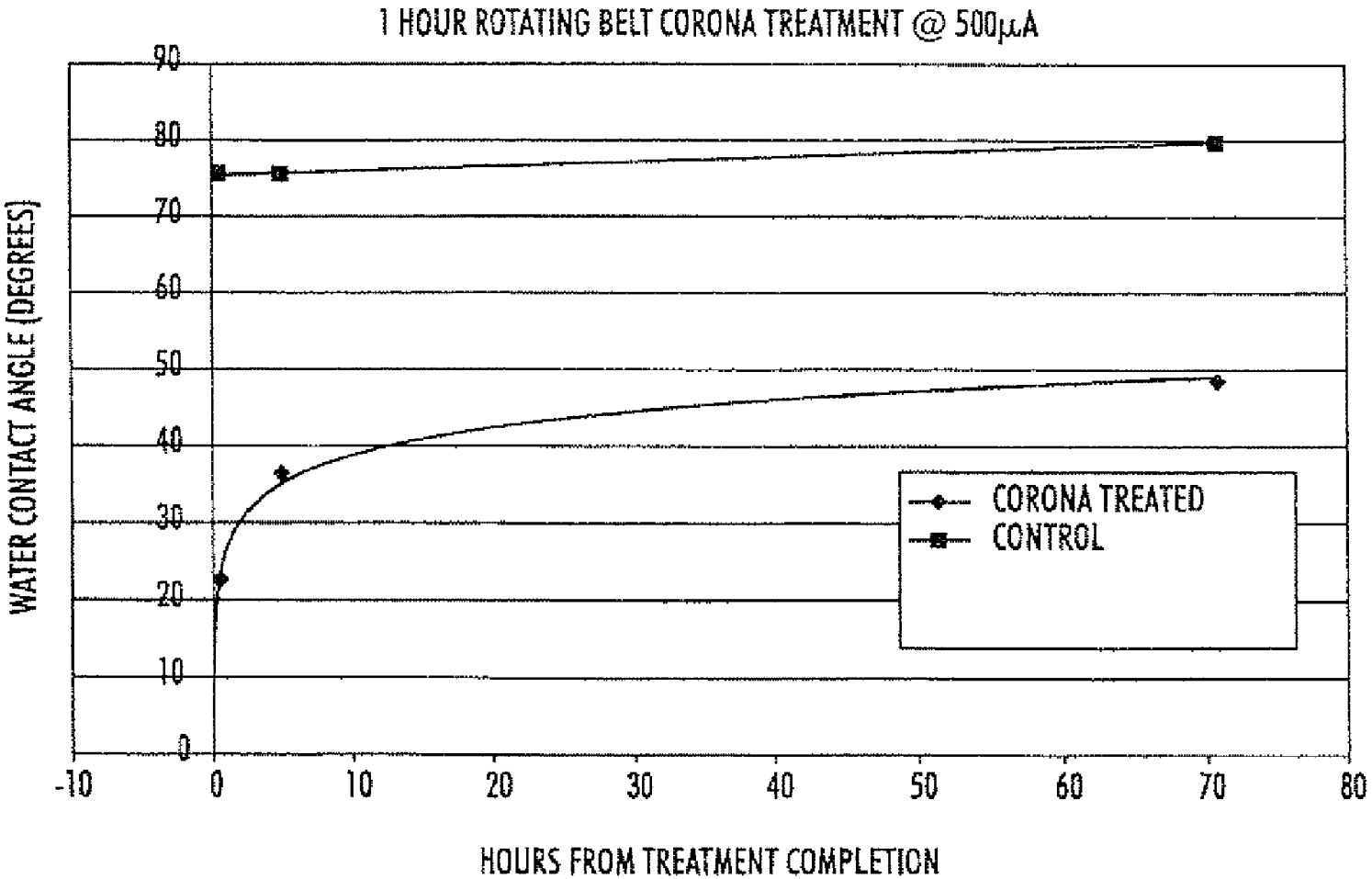
FIG. 3 shows a graph illustrating the results of measurement of the water contact angle plotted against the time after application of a corona treatment using an exemplary rotating belt corona treatment apparatus.

FIG. 3 shows a graph illustrating the results of the measurement of the water contact angle against time after application of a corona treatment using an exemplary rotating belt corona treatment apparatus. Table 2 shows the data plotted in FIG. 3. In order to assess the improvement in surface wetting properties of the intermediate transfer member, the contact angle of water and the corona treated and untreated surfaces of the intermediate transfer member was determined. In order to evaluate the water contact angle of the intermediate transfer member substrate after application of the corona treatment, a small portion of the treated sample is mounted onto a glass slide. The slide is then placed into a video contact angle measurement device, AST Products VCA 2500XE or the like. The device pipettes precise quantities of liquid, namely deionized water. The left and right side contact angles of the bead of liquid on the substrate are then recorded. These values are averaged over a number of measurement locations with a sample and reported in FIG. 3. The process is then repeated over a period of time to capture the degradation of the treatment effect.

TABLE 2

Water Contact Angle vs. Time after Application of Corona Treatment

| | Corona Treated ITB Substrate | | | Control | | |
|---|---|---|---|---|---|---|
| Time After Corona Treatment (in hours) | 0.5 | 4.8333 | 70.8333 | 0.5 | 4.8333 | 70.8333 |
| Contact Angle at Measurement Location 1 (in degrees) | 25 | 42 | 50 | 75 | 77 | 80 |
| Contact Angle at Measurement Location 2 (in degrees) | 20 | 42 | 50 | 71 | 77 | 79 |
| Contact Angle at Measurement Location 3 (in degrees) | 22 | 32 | 48 | 74 | 76 | 78 |
| Contact Angle at Measurement Location 4 (in degrees) | 24 | 31 | 48 | 80 | 72 | 81 |
| Contact Angle at Measurement Location 5 (in degrees) | 20 | 35 | 48 | 78 | 76 | 78 |
| Contact Angle at Measurement Location 6 (in degrees) | 26 | 41 | 49 | 72 | 77 | 82 |
| Contact Angle at Measurement Location 7 (in degrees) | 20 | 42 | 49 | 71 | 77 | 80 |
| Contact Angle at Measurement Location 8 (in degrees) | 23 | 32 | 47 | 77 | 74 | 78 |
| Contact Angle at Measurement Location 9 (in degrees) | 26 | 31 | 49 | 81 | 74 | 81 |
| Contact Angle at Measurement Location 10 (in degrees) | 20 | 35 | 46 | 77 | 76 | 80 |
| Average Contact Angle (in degrees) | 22.6 | 36.4 | 48.4 | 75.6 | 75.6 | 79.7 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A process for preparing an intermediate transfer member substrate with an overcoat layer without an adhesive or primer layer, the process comprising:

applying a corona treatment to the intermediate transfer member substrate; and applying the overcoat layer to the corona treated intermediate transfer member substrate, wherein the contact angle of water and a surface of the intermediate transfer member substrate after corona treatment is from about 10 degrees to about 50 degrees.

2. The process of claim 1, wherein the overcoat layer comprises a mixture of components comprising at least one component selected from a group consisting of tetrakis(butoxymethyl)glycoluril, an acrylic resin, p-toluenesulfonic acid, a silicone modified polyacrylate, and carbon black.

3. The process of claim 1, wherein the corona treatment is applied for a duration of about 10 seconds to about 1 hour.

4. The process of claim 1, wherein the corona treatment is applied at a voltage of from about 3,000 V to about 10,000 V.

5. The process of claim 1, wherein the corona treatment is applied at a current of from about 300 milliamps to about 600 milliamps.

6. The process of claim 1, wherein the intermediate transfer member substrate is in a roll form.

7. The process of claim 1, wherein the intermediate transfer member substrate is in a belt form.

8. The process of claim 1, further comprising adhering the overcoat layer to the intermediate transfer member substrate.

9. The process of claim 1, wherein the surface energy of the intermediate transfer member substrate after corona treatment is from about 60 dyne/cm to about 80 dyne/cm.

10. The process of claim 1, wherein the intermediate transfer member has a thickness in a range from about 60 micrometers to about 500 micrometers.

11. The process of claim 1, wherein the overcoat layer has a thickness in a range from about 5 micrometers to about 25 micrometers.

12. An intermediate transfer member comprising:

an intermediate transfer member substrate; and an overcoat layer adhered to the intermediate transfer member substrate, wherein the overcoat layer is adhered to the substrate in the absence of an adhesive, and a contact angle of water and a surface of the intermediate transfer member substrate after corona treatment is from about 10 degrees to about 50 degrees.

13. The intermediate transfer member substrate of claim 12, wherein the overcoat layer comprises a mixture of components comprising at least one component selected from a group consisting of tetrakis(butoxymethyl)glycoluril, an acrylic resin, p-toluenesulfonic acid, a silicone modified polyacrylate, and carbon black.

14. The intermediate transfer member substrate of claim 12, wherein the intermediate transfer member substrate comprises at least one compound selected from a group consisting of a polyamideimide, a polyanaline polyimide, a carbon-filled polyimide, and a carbon-filled polycarbonate.

15. The intermediate transfer member substrate of claim 12, wherein the intermediate transfer member substrate is in a roll form.

16. The intermediate transfer member substrate of claim 12, wherein the intermediate transfer member substrate is in a belt form.

17. An electrophotographic apparatus comprising:

a photoreceptor;

a developer;

an intermediate transfer member comprising the intermediate transfer member substrate according to claim 12; and a fuser member.

18. The intermediate transfer member substrate of claim 12, wherein the intermediate transfer member has a thickness in a range from about 60 micrometers to about 500 micrometers.

19. The intermediate transfer member substrate of claim 12, wherein the overcoat layer has a thickness in a range from about 5 micrometers to about 25 micrometers.

20. An intermediate transfer member comprising:

an intermediate transfer member substrate; and an overcoat layer adhered to the intermediate transfer member substrate, wherein the overcoat layer is adhered to the substrate in the absence of an adhesive, and the surface energy of the intermediate transfer member substrate after corona treatment is from about 60 dyne/cm to about 80 dyne/cm.

* * * * *